US008611549B2

(12) United States Patent
Hsi et al.

(10) Patent No.: US 8,611,549 B2
(45) Date of Patent: Dec. 17, 2013

(54) DETECTION CIRCUIT FOR AUDIO DEVICE

(75) Inventors: Mao-Shun Hsi, New Taipei (TW); San-Yuan Chuang, New Taipei (TW); Kun-Yu Hu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 306 days.

(21) Appl. No.: 13/113,754

(22) Filed: May 23, 2011

(65) Prior Publication Data

US 2012/0093328 A1 Apr. 19, 2012

(30) Foreign Application Priority Data

Oct. 13, 2010 (TW) ..... 99134968 A

(51) Int. Cl.
*H04R 29/00* (2006.01)

(52) U.S. Cl.
USPC ..... 381/58; 381/81; 381/123

(58) Field of Classification Search
USPC ..... 381/58, 77, 81, 85, 123; 700/94
See application file for complete search history.

(56) References Cited

U.S. PATENT DOCUMENTS 6,069,960 A * 5/2000 Mizukami et al. ..... 381/74
6,856,046 B1 * 2/2005 Scarlett et al. ..... 307/125
7,248,707 B2 * 7/2007 Peng et al. ..... 381/74

* cited by examiner

*Primary Examiner* — Disler Paul
(74) *Attorney, Agent, or Firm* — Altis Law Group, Inc.

(57) ABSTRACT

A detection circuit of an electronic device, includes a jack circuit, a first switch, a second switch, and a detection end. The jack circuit includes a type detection pin and a connection detection pin. The first switch includes a first control end. The connection detection pin is connected to the first control end to control the first switch on or off according to whether the audio device is connected to the electronic device. The second switch is connected to ground via the first switch. The second switch includes a second control end. The type detection pin is connected to the second control end to control the second switch on or off according to the type of the audio device. The detection end is connected to the first switch via a first resistor, and is connected to the second switch via a second resistor. The detection end is adapted to generate different signals to indicate a connection status of the electronic device and the audio device.

12 Claims, 5 Drawing Sheets

DETECTION CIRCUIT FOR AUDIO DEVICE

BACKGROUND

1. Technical Field

The present disclosure relates to detection circuits, and particularly to a detection circuit for an audio device.

2. Description of Related Art

When an external device is plugged into an electronic device, the communication protocol between the electronic device and the external device, or programs capable of exchanging a predetermined control signal or characteristic between the electronic device and the external device, is usually used to notify whether the external device is plugged into the electronic device. For example, when an audio device, such as an earphone, is plugged into a music player, the music player and the earphone build a communication protocol to transmit audio signals. However, different audio devices often build up different communication protocols with the music players. For example, a first kind of audio device, which only can receive audio signals, and a second kind of audio device, which can receive and send audio signals, usually have different communication protocols. However, the music player often cannot detect which kind of audio device is connected to provide proper communication protocol.

Therefore, there is room for improvement within the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
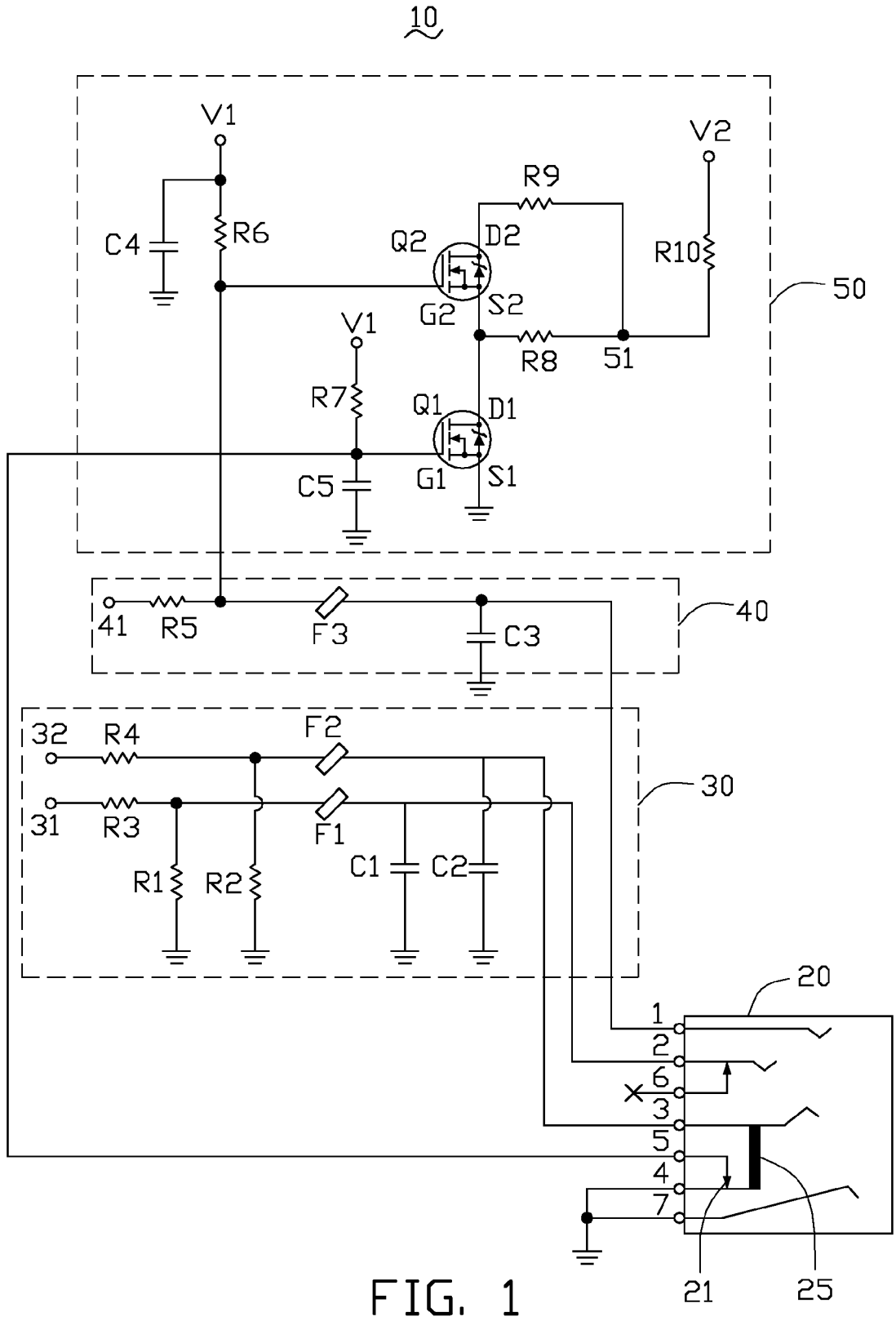
FIG. 1 is a circuit diagram of an embodiment of a detection circuit for an electronic device.

Referring to FIG. 1, a detection circuit for an audio device in accordance with an embodiment of the present disclosure, includes an jack circuit 20, an audio signal output circuit 30, an audio signal input circuit 40, and a control circuit 50. The detection circuit is equipped on an electronic device 10, such as a music player.

The jack circuit 20 includes a first pin 1, a second pin 2, a third pin 3, a fourth pin 4, a fifth pin 5, a sixth pin 6, and a seventh pin 7. The first pin 1 is a type detection pin. The first pin 1 is used to receive an audio signal. The second pin 2 is used to output a left channel audio signal. The third pin 3 is used to output a right channel audio signal. The fourth pin 4 and the seventh pin 7 are connected to ground. The sixth pin 6 is idle. The fifth pin 5 is a connection detection pin. The fifth pin 5 is connected to the fourth pin 4 via a movable contact terminal 21. The third pin 3 and the fourth pin 4 are combined together via an insulated block 25. The third pin 3 and the fourth pin 4 can move together.

The audio signal output circuit 30 includes a first magnetic bead F1, a second magnetic bead F2, a first capacitor C1, a second capacitor C2, a first resistor R1, a second capacitor R2, a third capacitor R3, and a fourth capacitor R4. The second pin 2 of the jack circuit 20 is connected to ground via the first capacitor C1. The second pin 2 also connects to a left channel audio signal output end 31 via the first magnetic bead F1 and the third resistor R3. The second pin 2 also connects to ground via the first magnetic bead F1 and the first resistor R1. The third pin 3 of the jack circuit 20 is connected to ground via the second capacitor C2. The third pin 3 also connects to a right channel audio signal output end 32 via the second magnetic bead F2 and the fourth resistor R4. The third pin 3 also connects to ground via the second magnetic bead F2 and the second resistor R2.

The audio signal input circuit 40 includes a third capacitor C3, a third magnetic bead F3, and a fifth resistor R5. The first pin 1 is connected to ground via the third capacitor C3. The first pin 1 also connects to an audio signal input end 41 via the third capacitor C3 and the fifth resistor R5.

The control circuit 50 includes a sixth resistor R6, a seventh resistor R7, and a eighth resistor R8, a ninth resistor R9, and a tenth resistor R10, a fourth capacitor C4, a fifth capacitor C5, a first switch Q1, and a second switch Q2. In one embodiment, the first switch Q1 and the second switch Q2 are N channel MOSFETs (metallic oxide semiconductor field effect transistor).

The fifth pin 5 of the jack circuit 20 is connected to a first grid G1 of the first transistor Q1. The first gird G1 of the first transistor Q1 is also connected to a first voltage V1 via the seventh resistor R7. The first voltage V1 is +5V. The first grid G1 is also connected to ground via a capacitor C5. A first drain D1 of the first transistor Q1 is connected to a detection end 51 via the eighth resistor R8. A first source S1 of the first transistor Q1 is connected to ground. The detection end 51 further connects to a second voltage V2 via the tenth resistor R10.

A second grid G2 of the second transistor Q2 is connected to the first voltage V1 via the sixth resistor R6. The first voltage V1 is connected to ground via the fourth capacitor C4. The second grid G2 of the second transistor Q2 is connected to a connected point of the third magnetic bead F3 and the fifth resistor R5. A second drain D2 of the second transistor Q2 is connected to the detection end 51 via the ninth resistor R9. The second source S2 of the second transistor Q2 is connected to the first drain D1 of the first transistor Q1.

When there is no plug of an audio device (such a headphone) inserted into the jack circuit 20, the fourth pin 4 and the fifth pin 5 are connected to ground. The first transistor Q1 is off. A voltage on the detection end 51 is equal the second voltage V2.

Figure 2:
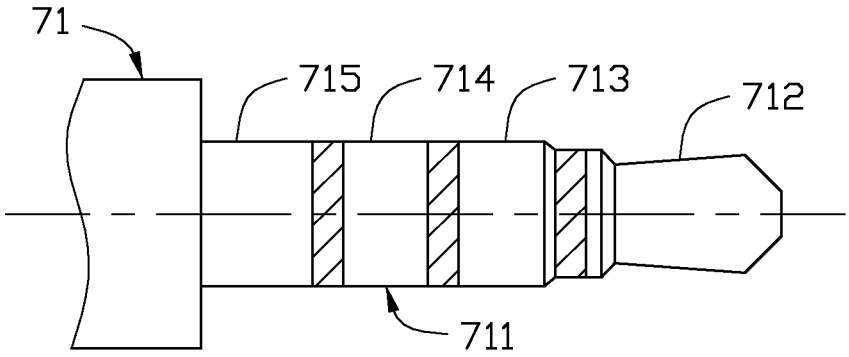
FIG. 2 is a view of a first plug of a first audio device.
Figure 3:
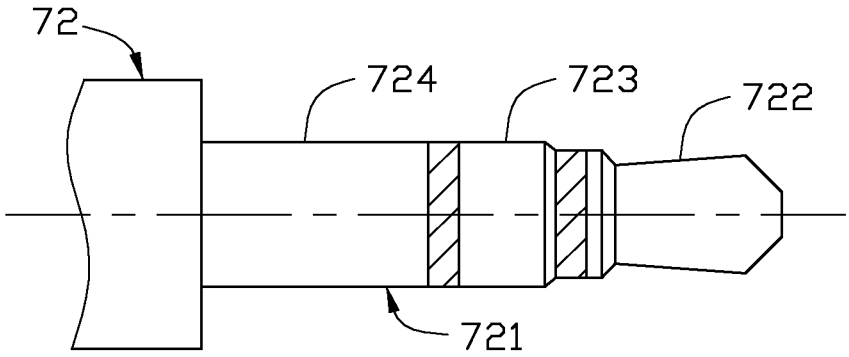
FIG. 3 is a view of a second plug of a second audio device.

Referring to FIGS. 2 and 3, two different plugs of two different audio devices are shown. FIG. 2 shows a first plug 711 of a first audio device 71. The first plug 711 includes a first left channel audio signal input portion 712, a first right channel audio signal input portion 713, a first audio signal output portion 714, and a first ground portion 715. FIG. 3 shows a second plug 721 of a second audio device 72. The second plug 721 includes a second left channel audio signal input portion 722, a second right channel audio signal input portion 723, and a second ground portion 724.

Figure 4:
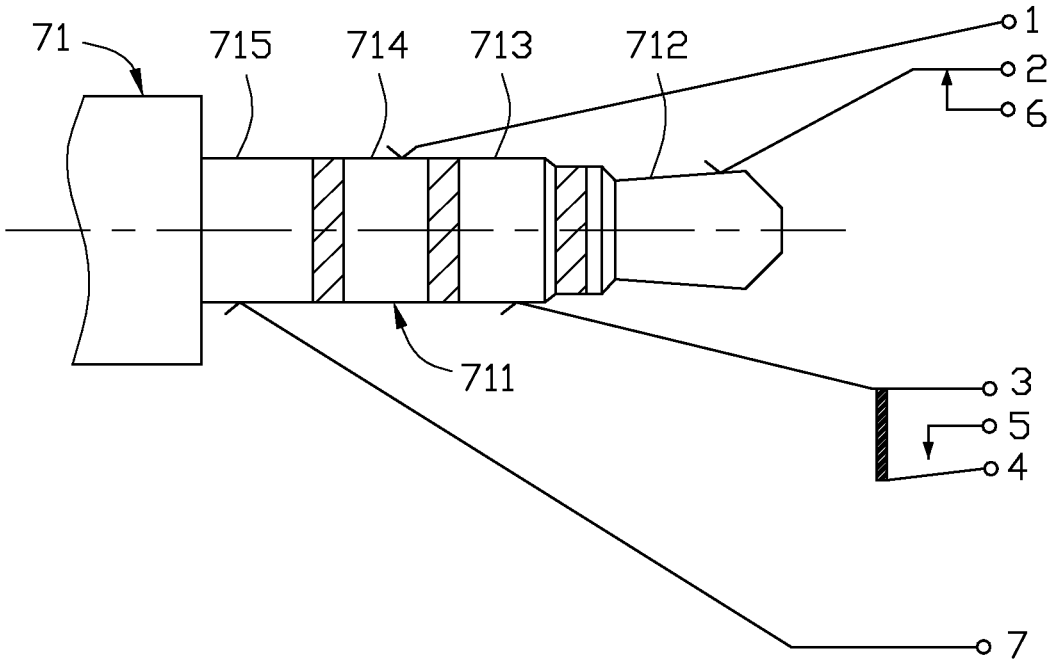
FIG. 4 is a view of the first plug of FIG. 2 connected to a jack circuit of the detection circuit of FIG. 1.

Referring to FIGS. 1 and 4, when the first plug 711 is connected to the jack circuit 20, the second pin 2 is coupled to the first left channel audio signal input portion 712. The third pin 3 is coupled to the first right channel audio signal input portion 713. Simultaneously, the first right channel audio signal input portion 713 pushes the third pin 3. The fourth pin 4 moves together with the third pin 3 and is separated from the fifth pin 5. The first pin 1 is coupled to the first audio signal output portion 714. The seventh pin 7 is coupled to the first ground portion 715. At this position, a voltage level on the fifth pin 5 is high. The first transistor Q1 is turned on. The voltage level on the first pin 1 is high. The second transistor Q2 is turned on. Therefore, a first detection signal is generated on the detection end 51 to indicate that the first audio device 71 is connected to the electronic device 10. A voltage level of the first detection signal is equal to a division voltage of the second voltage V2 loaded on the parallel connected resistors R8 and R9.

Figure 5:
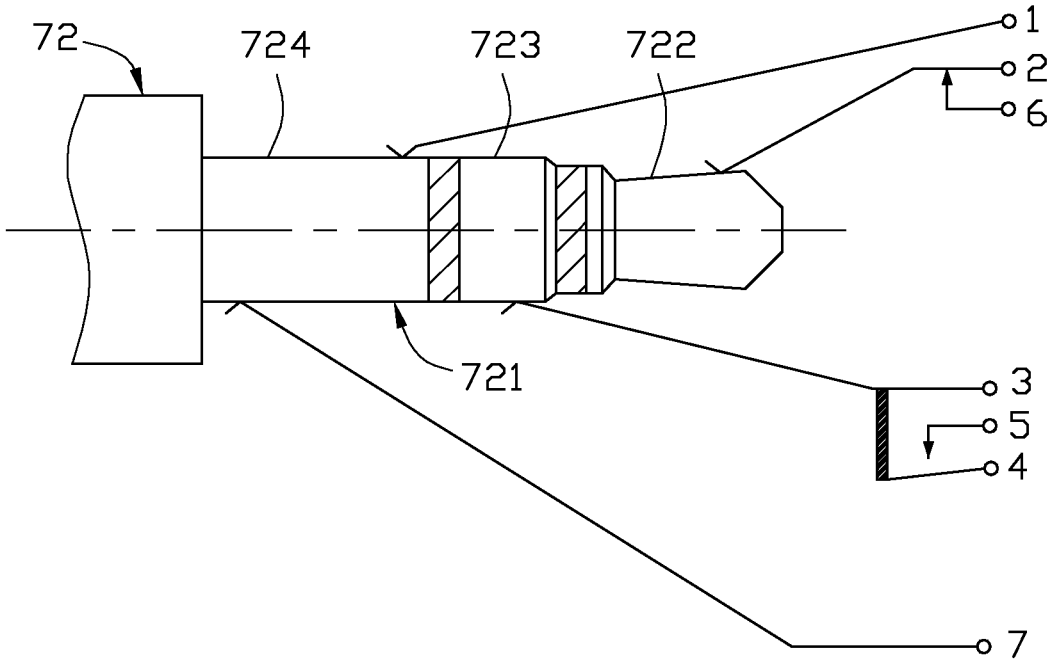
FIG. 5 is a view of the second plug of FIG. 3 connected to the jack circuit of the detection of FIG. 1.

Referring to FIGS. 1 and 5, when the second plug 721 is connected to the jack circuit 20, the second pin 2 is coupled to the second left channel audio signal input portion 722. The third pin 3 is coupled to the second right channel audio signal input portion 723. Simultaneously, the first right channel audio signal input portion 713 pushes the third pin 3. The fourth pin 4 moves together with the third pin 3 and is separated from the fifth pin 5. The first pin 1 and the seventh pin 7 are coupled to the second ground portion 724. At this position, a voltage level on the fifth pin 5 is high. The first transistor Q1 is turned on. The voltage level on the first pin 1 is low. The second transistor Q2 is turned off. Therefore, a second detection signal is generated on the detection end 51 to indicate that the second audio device 72 is connected to the electronic device 10. A voltage level of the second detection signal is equal to a division voltage of the second voltage V2 loaded on the resistor R8.

Therefore, the detection circuit can detect whether there is an audio device connected to the electronic device 10 and which audio device is connected to the electronic device 10 according to detection from the detection end 51.

It is to be understood, however, that even though numerous characteristics and advantages of the embodiments have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed. Depending on the embodiment, certain of the steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

What is claimed is:

1. A detection circuit of an electronic device, comprising:

a jack circuit comprising a type detection pin and a connection detection pin, the connection detection pin adapted to detect whether an audio device is connected to the electronic device, the type detection pin adapted to detect a type of audio device when the audio device is connected thereto;

a first switch comprising a first control end, the connection detection pin is connected to the first control end, the connection detection pin adapted to turn the first switch on or off according to whether the audio device is connected to the electronic device;

a second switch connected to ground via the first switch, the second switch comprising a second control end, the type detection pin is connected to the second control end, the type detection pin adapted to control the second switch on or off according to the type of the audio device; and a detection end connected to the first switch via a first resistor and connected to the second switch via a second resistor, the detection end adapted to generate different signals to indicate a connection status of the electronic device and the audio device.

2. The detection circuit of claim 1, wherein the first control end is adapted to turn on the first switch when the audio device is connected to the electronic device.

3. The detection circuit of claim 2, wherein the jack circuit further comprises a ground pin which is connected to ground, the connection detection pin is connected to the ground pin via a movable contact terminal, and the movable contact terminal is adapted to separate from the ground pin when the audio device is connected to the electronic device.

4. The detection circuit of claim 3, wherein the first switch is a first N channel MOSFET, the first N channel MOSFET comprises a first grid, a first drain, and a first source; the first grid is connected to the first control end, the first drain is connected to the second switch, the first drain is connected to the detection end via the first resistor, and the first source is connected to ground.

5. The detection circuit of claim 1, wherein the second control end is adapted to turn on the second switch when a first type of audio device, which is capable of output audio signal, is connected to the electronic device.

6. The detection circuit of claim 5, wherein the second switch is a second N channel MOSFET, the second N channel MOSFET comprises a second grid, a second drain, and a second source; the second grid is connected to the second control end, the second drain is connected to the detection end via the second resistor, and the second source is connected to the first switch.

7. The detection circuit of claim 1, wherein the second control end is adapted to turn off the second switch when a second type of audio device, which is not capable of output audio signal, is connected to the electronic device.

8. The detection circuit of claim 7, wherein the second switch is a second N channel MOSFET, the second N channel MOSFET comprises a second grid, a second drain, and a second source; the second grid is connected to the second control end, the second drain is connected to the detection end via the second resistor, and the second source is connected to the first switch.

9. The detection circuit of claim 1, wherein the detection end is connected to a voltage source via a third resistor.

10. A detection circuit for an electronic circuit, comprising:

a jack circuit comprising a connection detection pin; and a first switch connected to ground, the first switch comprising a first control end, the connection detection pin connected to the first control end; a detection end connected to the first switch via a first resistor and connected to a voltage source via a third resistor;

wherein the jack circuit further comprises a type detection pin, the type detection pin is connected to a second control end of a second switch, the second switch is a second N channel MOSFET, the second N channel MOSFET comprises a second grid, a second drain, and a second source; the second grid is connected to the second control end, the second drain is connected to the detection end via a second resistor, and the second source is connected to the first switch;

wherein the first switch is adapted to run between a first state and a second state; in the first state, the connection detection pin detects a connection of an audio device, the first switch and the second switch are turned on, and the detection end outputs a first signal; in the second state, the connection detection pin do not detects the connection of the audio device, the first switch is turned off and the second switch is turned off , and the detection end outputs a second signal.

11. The detection circuit of claim 10, wherein the jack circuit further comprises a ground pin which is connected to ground, the connection detection pin is connected to the ground pin via a movable contact terminal, and the movable contact terminal is separated from the ground pin in the first state.

12. The detection circuit of claim 11, wherein the first switch is a first N channel MOSFET, the first N channel MOSFET comprises a first grid, a first drain, and a first source; the first grid is connected to the first control end, the first drain is connected to the detection end via the first resistor, and the first source is connected to ground.

* * * * *